United States Patent [19]

Dougherty et al.

[11] Patent Number: 4,891,546

[45] Date of Patent: Jan. 2, 1990

[54] FRONT ASSEMBLY FOR A TENSION MASK COLOR CATHODE RAY TUBE HAVING A LASER-DEFLECTING SHADOW MASK SUPPORT STRUCTURE

[75] Inventors: Lawrence W. Dougherty, Sleepy Hollow; James R. Fendley, Arlington Heights; Charles J. Prazak, Elmhurst; Paul Strauss, Chicago, all of Ill.

[73] Assignee: Zenith Electronics Corporation

[21] Appl. No.: 269,822

[22] Filed: Nov. 10, 1988

[51] Int. Cl.[4] ..... H01J 29/07

[52] U.S. Cl. ..... 313/407; 313/402; 445/30

[58] Field of Search ..... 313/402, 407; 445/37, 445/47, 30

[56] References Cited

U.S. PATENT DOCUMENTS

| | | | |
|---|---|---|---|
| 4,686,416 | 8/1987 | Dougherty et al. | 313/407 |
| 4,695,761 | 9/1987 | Fendley | 313/407 |
| 4,804,881 | 2/1989 | Strauss | 313/407 |

*Primary Examiner*—Kenneth Wieder

[57] ABSTRACT

A front assembly is disclosed for a tension mask color cathode ray tube. The assembly comprises a faceplate having a tensed foil shadow mask supported by mask support means, and means for shielding the faceplate from a high-energy beam used to trim waste material from the mask following its attachment to the mask support means.

18 Claims, 2 Drawing Sheets

FRONT ASSEMBLY FOR A TENSION MASK COLOR CATHODE RAY TUBE HAVING A LASER-DEFLECTING SHADOW MASK SUPPORT STRUCTURE

CROSS-REFERENCE TO RELATED APPLICATIONS AND PATENTS

This application is related to but in no way dependent upon copending applications Ser. No. 051,896 filed May 18, 1988, now U.S. Pat. No. 4,790,786; Ser. No. 058,095 filed June 4, 1987, now U.S. Pat. No. 4,828,523; Ser. No. 140,464 filed Mar. 4, 1988; Ser. No. 178,175 filed Apr. 6, 1988; Ser. No. 831,699 filed Feb. 21, 1986, now U. S. Pat. No. 4,686,416; Ser. No. 832,493 filed Feb. 21, 1986, now U.S. Pat. No. 4,701,678; Ser. No. 832,556 filed Feb. 21, 1986, now U.S. Pat. No. 4,695,761; Ser. No. 866,030 filed Apr. 21, 1986, now U.S. Pat. No. 4,737,681, all of common ownership herewith.

BACKGROUND OF THE INVENTION

Field of the Invention

This invention relates to color cathode ray picture tubes, and is addressed specifically to an improved front assembly for color tubes having shadow masks of the tension foil type in association with a substantially flat faceplate. The invention is useful in color tubes of various types, including those used in home entertainment television receivers, and in medium-resolution and high-resolution tubes intended for color monitors.

The use of the foil-type flat tension mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate, and as the beam-passing apertures move out of registration with their associated phosphor elements on the faceplate.

The tension mask, when heated, distorts in a manner quite different from that of the conventional mask. If the entire mask is heated uniformly, there is no doming and no distortion until tension is completely lost; just before that point, wrinkling may occur in the corners. If only portions of the mask are heated, those portions expand and the unheated portions contract, resulting in displacements within the plane of the mask; i.e., the mask remains flat.

The tension foil shadow mask is a part of the cathode ray tube front assembly, and is located in close adjacency to the faceplate. The front assembly comprises the faceplate with its screen consisting of deposits of light-emitting phosphors, a shadow mask, and support means for the mask. As used herein, the term "shadow mask" means an apertured metallic foil which may, by way of example, be about 0.001 inch thick, or less. The mask must be supported in high tension a predetermined distance from the inner surface of the cathode ray tube faceplate; this distance is known as the "Q-distance." As is well known in the art, the shadow mask acts as a color-selection electrode, or parallax barrier, which ensures that each of the three beams generated by the electron gun located in the neck of the tube lands only on its assigned phosphor deposits.

The requirements for a support means for a foil shadow mask are stringent. As has been noted, the foil shadow mask is normally mounted under high tension; e.g., 30 lb./inch. The support means must be of high rigidity so the mask is held immovable; an inward movement of the mask of as little as 0.0002 inch in the finished tube can cause the loss of guard band. Also, it is desirable that the shadow mask support means be of such configuration and material composition as to be compatible with the means to which it is attached. As an example, if the support means is attached to glass, such as the glass of the inner surface of the faceplate, the support means must have a coefficient of thermal contraction compatible with that of the glass, and by its composition, be bondable to glass. Also, the support means must be of such composition and structure that the mask can be secured to it by production-worthy techniques such as high-energy beam welding. Further, it is essential that the support means provide a suitable surface for mounting and securing the mask. The material of which the support structure is composed must be adaptable to machining or to other forms of shaping so the structure can be contoured into near-perfect flatness. Otherwise, voids will exist between the metal of the mask and the support structure, preventing positive, uniform contact of the mask to the support structure necessary for proper mask securement.

Means for securing the shadow mask support to the inner surface of the faceplate may comprise a cement in the form of a devitrifying solder glass, also known as "frit."

During the manufacturing process, a high-energy beam, noted as being a pulsed laser beam, is used to weld foil masks to the metal support structures secured to the inner surface of the faceplates. The same beam, in a higher-energy continuous-wave mode, is used to trim post-weld waste mask material. It was found that the overshoot of the cut-off beam, when falling on the glass of the inner surface of the faceplate, caused cracking and spalling of the glass. To prevent this destruction effect, an aluminum faceplate shield about 5 mils thick was initially used in production to intercept the high-energy beam and thus shield the glass of the faceplate. The shield was in the form of a frame which enclosed the mask support structure. The limited space between the mask and the panel made it difficult to design a structurally sound shield, one that would fit tightly enough against the support structure to prevent penetration of the cut-off beam past the shield. Also, the use of the shield required two additional process steps--that of emplacing the shield, and that of removing it. If by oversight, the shield was not put in place, a finished front assembly--that is, a screened assembly with the mask secured and ready to be fitted to a funnel, had to be scrapped because of consequent damage to the faceplate.

OBJECTS OF THE INVENTION

It is a general object of the invention to provide an improved apparatus for use in the faceplate assembly of a color cathode ray tube having a tensed foil shadow mask and a substantially flat faceplate.

It is an object of the invention to provide an improved support structure for mounting a foil shadow mask in tension in association with a substantially flat faceplate.

It is another object of the invention to provide an improved mask support structure that prevents damage to the inner surface of the faceplate during a production process in which waste material is trimmed from the mask.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
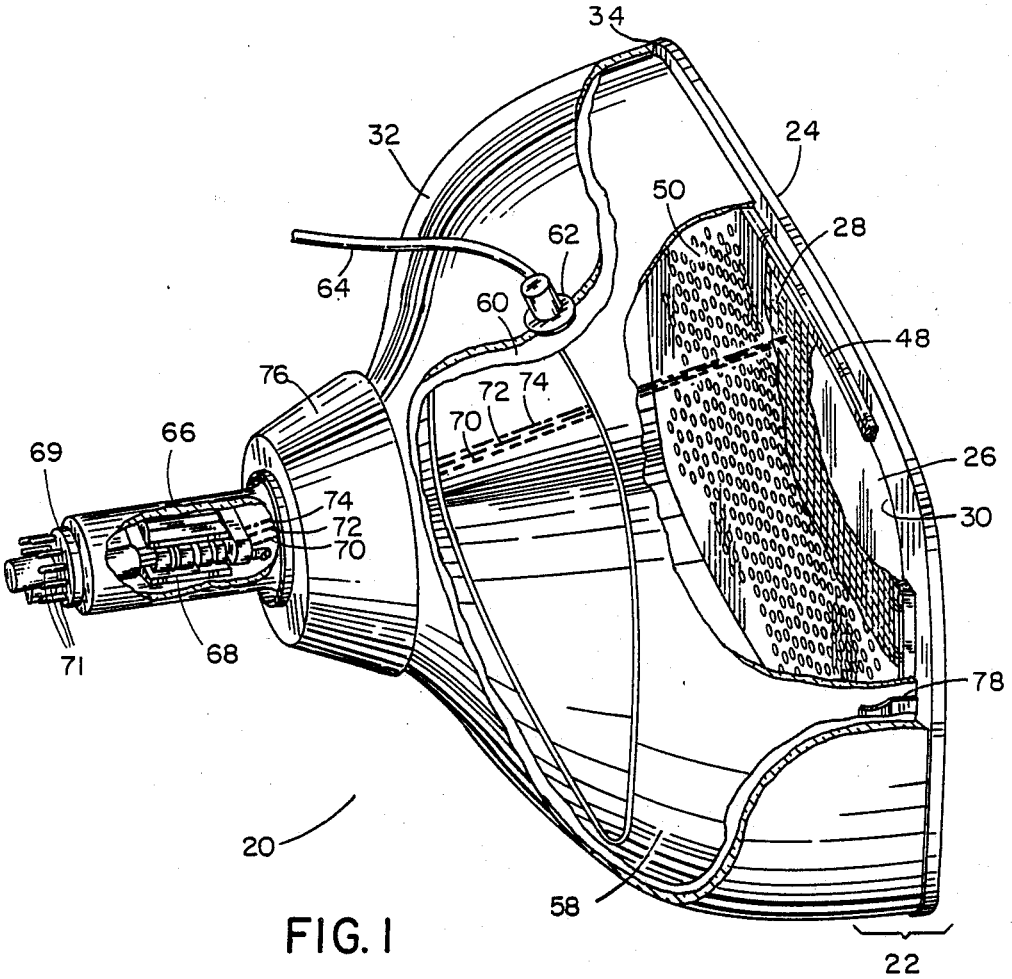
FIG. 1 is a side view in perspective of a color cathode ray tube having an improved shadow mask support structure according to the invention, with cut-away sections that indicate the location and relation of the support structure to other major tube components.

A cathode ray tube having a faceplate assembly having an improved mask support structure according to the invention is depicted in FIG. 1. The tube and its component parts are identified in FIGS. 1, 2 and 3, and described in the following paragraphs in this sequence: reference number, a reference name, and a brief description of structure, interconnections, relationship, functions, operation, and/or result, as appropriate.

Figure 2:
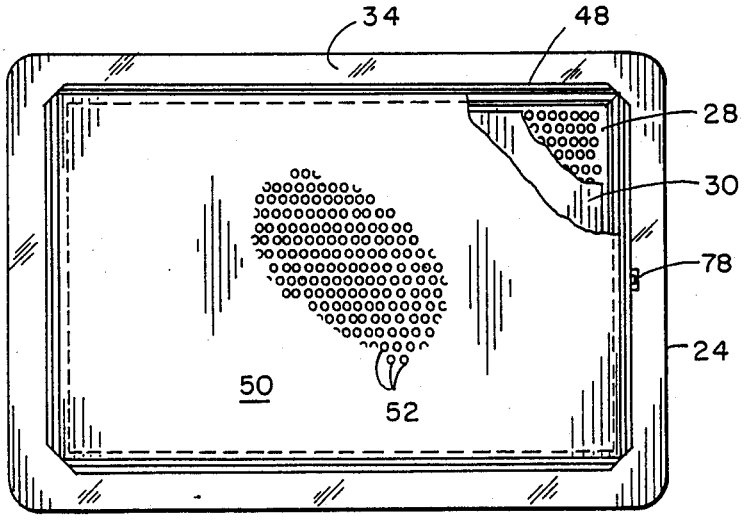
FIG. 2 is a plan view of the front assembly of the tube shown by FIG. 1, taken from the aspect of the electron gun, and with parts cut away to show the relationship of the embodiment of the mask support structure shown by FIG. 1 with the faceplate and the shadow mask; an inset depicts mask apertures greatly enlarged.
Figure 3:
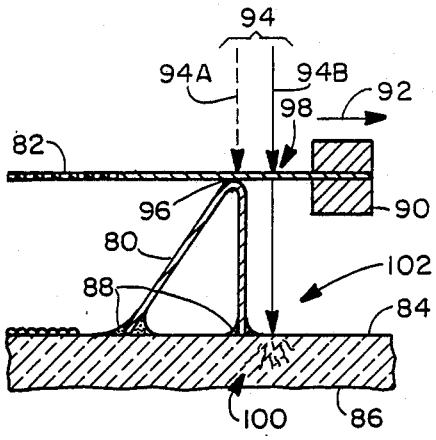
FIG. 3 (PRIOR ART)
FIG. 3 is a cross-sectional view in elevation of a prior art tension mask support structure.

20: color cathode ray tube
22: front assembly of a cathode ray tube
24: glass faceplate
26: inner surface of faceplate 24
28: centrally disposed phosphor screen
30: film of aluminum
32: funnel
34: peripheral sealing area of faceplate 24, adapted to mate with the peripheral sealing area of funnel 32
48: a frame-like shadow mask support structure according to the invention located on opposed sides of the screen 28 for receiving and securing a tensed foil shadow mask; the support structure is depicted by way of example in FIGS. 1–3 as comprising a unitary structure; that is, a one-piece structure, although it may as well be mounted on the faceplate in sections
50: metal foil shadow mask; the mask is mounted in tension on support structure 48 and secured thereto
52: shadow mask apertures, indicated as greatly enlarged in the inset in FIG. 2 for illustrative purposes
58: internal magnetic shield
60: internal conductive coating on funnel
62: anode button
64: high-voltage conductor
66: neck of tube
68: in-line electron gun providing three discrete in-line electron beams 70, 72 and 74 for exciting the respective redlight-emitting, green-light-emitting, and blue-light-emitting phosphor deposits on screen 28
69: base of tube
71: metal pins for conducting operating voltages and video signals through base of tube 69 to electron gun 68
76: yoke which provides for the traverse of beams 70, 72 and 74 across screen 28
78: contact spring which provides an electrical path between the funnel coating 60 and the mask support structure 48.

As indicated by FIGS. 1 and 2, a front assembly 22 for a cathode ray tube 20 includes a glass faceplate 24 having on its inner surface 26 a centrally disposed phosphor screen 28. A foil shadow mask 50 is mounted in tension on a shadow mask support structure 48 located on opposed sides of screen 28 and secured In FIG. 3, there is depicted a prior art shadow mask support structure 80 which provides a highly effective means for mounting a tensed foil shadow mask 82. The general configuration of the support structure 80 shown by FIG. 3 is the subject of U.S. Pat. Nos. 4,686,416, 4,695,761 and 4,701,678, also of common ownership. Structure 80 is shown as mounted on the inner surface 84 of a faceplate 86, and attached to the inner surface 84 by deposits of glass frit 88. A manufacturing process is depicted in which the mask is indicated diagrammatically as being stretched by stretcher fixture 90, with the direction of stretching indicated by the associated arrow 92. (A factory fixture frame that provides for stretching and mounting a foil shadow mask is fully described and claimed in referent copending application Ser. No. 051,896, of common ownership herewith.) The manufacturing process is depicted highly schematically in FIG. 3 in which a high-energy beam 94, indicated as being in a pulsed mode by dashed line 94A, provides for welding mask 82 to the mask-receiving surface 96 of mask support structure 80 while mask 82 is under the tension provided by stretching fixture 90. The high-energy beam is preferably a laser beam.

When the welding of the mask 82 to the support structure 80 is completed, the high-energy beam 94 is moved outwardly and changed to a high-power continuous-wave mode indicated by the solid line 94B, and focused on cut-off point 98 for severing the mask (and releasing the front assembly) from the stretching fixture 92. The post-weld mask waste material is removed from the fixture when the fixture is prepared to receive and stretch another foil shadow mask.

The means and process for welding a foil mask to a support structure by a high-energy beam, and severing the mask, is fully described and claimed in referent copending application Ser. No. 058,095, of common ownership. The high-energy beam used is a laser beam which is modulated first in pulsed mode for securing the mask to the support structure by sequential spot welding, and secondly, in a higher energy continuous wave mode for severing the mask from the mask stretching and holding fixture, which preferably comprises the aforementioned factory fixture frame the subject of referent copending application Ser. No. 051,896.

As has been noted heretofore, it was found that in the cut-off mode of beam 94; that is, in the high-energy, continuous wave mode, the overshoot of the beam fell on the inner surface 84 of faceplate 86 of, causing spalling and cracking of the glass, as indicated by the fret marks 100 in the area of the the point of impact 102 of cut-off beam 94B. Also as has been indicated, the use of a shield to protect the glass of the faceplate was found to be less than satisfactory. The present invention provides for a novel solution to the problem.

A front assembly for a tension mask color cathode ray tube according to the invention comprises a faceplate having a tensed foil shadow mask supported by mask support means, and means for shielding the faceplate from a high-energy beam used to trim mask waste material following attachment of the mask to the mask support means.

Figure 4:
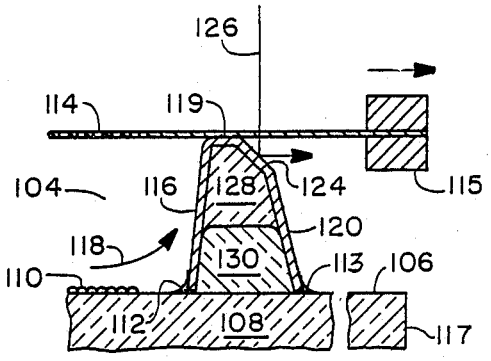
FIG. 4 is a cross-sectional view in elevation of the tension mask support structure according to the invention depicted in FIGS. 1 and 2; the structure is shown as attached to a faceplate.

FIG. 4 depicts a foil shadow mask support structure 104 according to the invention so structured and arranged as to intercept a high-energy beam used to trim post-weld shadow mask waste material and protect the faceplate from the beam. Support structure 104 is indicated as being secured to the inner surface 106 of a faceplate 108 on opposed sides of a phosphor screen 110, noted as being centrally disposed on the inner surface 106; the means of securement is indicated as comprising deposits of frit 112 and 114. A foil shadow mask 114 is indicated as being stretched by stretching fixture 115, as indicated by the associated arrow, to place the mask 114 under proper tension. Support structure is depicted as providing a surface 119 for receiving and securing shadow mask 114, and is so structured and arranged as to intercept a high-energy beam used to trim post-weld mask waste material and protect the faceplate from the beam.

Mask support structure 104 is indicated as comprising an inner side 116 shown as being near-perpendicular to and secured to a faceplate 108, with inner side 116 leaning toward the outer edge 117 of faceplate 108. The purpose of this orientation of inner side 116 is to conduct from the screen area any excess of coating material, indicated by arrow 118, applied during the spin application process in which phosphor-contained slurries are sequentially applied to the screening area to form screen 110; this inventive concept is fully described and claimed in referent U.S. Pat. No. 4,686,416 of common ownership herewith.

Support structure 104 is indicated as having a shorter, outer side 120 near-perpendicular to and secured to faceplate 108; outer side 120 will be noted as leaning toward the inner side 116 of support structure 104. The two sides are indicated as having an intercepting side 124 joined to the outer side's terminus farthest from faceplate 106. Intercepting side 124 is depicted as defining a non-zero angle relative to the inner surface 106 of faceplate 108 to reflect a high-energy beam 126 used for severing the mask 114 (as described heretofore) sideways and away from faceplate 108. The non-zero angle may comprise, according to the invention, an angle in the range of 40 to 50 degrees, and preferably about 45 degrees.

The metal of the support structure preferably comprises Alloy No. 27 manufactured by Carpenter Technology of Reading, Pa.; this material has a CTC (coefficient of thermal expansion) of approximately 105 to $109\times10^{-7}$ in/in/degree C. over the range of the temperatures required for devitrification--from ambient temperature to 435 degrees C. The glass of the faceplate in turn has a CTC of approximately $103\times10^{-7}$/degree C. over the designated range.

Support structure 104 is noted as being filled by way of example with two devitrified solder glass compositions 128 and 130, each having a different viscosity when in the form of an undevitrified solder glass paste. This inventive means, which provides for complete filling of the hollow support structure, is fully set forth and claimed in referent copending application Ser. No. 178,175 of common ownership herewith.

FIGS. 5, 6, 8 and 7 depict shadow mask support structures according to the invention which are composed of a ceramic. Each will be noted as being secured by deposits of frit to a glass faceplate having a centrally disposed phosphor screen, all as described heretofore with regard to preceding FIG. 4. Also, each will be noted as having a shadow mask attached thereto by means of a pulsed high-energy beam indicated by the dashed line. The mask is also indicated in each figure as being placed in tension by clamping means indicated diagrammatically; an associated arrow indicates direction of the pull on the mask to achieve the desired tension. The features of the novel configurations shown by each figure that comprise the invention are set forth in the following paragraphs.

The metal components shown may be secured to the ceramic components by means of a non-devitrifying solder glass ("frit") such as, by way of example, solder glass No. CV-130 manufactured by Owens-Illinois of Toledo, Ohio. Alternately, the metal components may be secured by a porcelain enamel such as that manufactured by Mobay Corporation, Baltimore, Md., under the designation QJ150. The product, which is supplied in the form of a powder, is preferably mixed with amyl acetate nitrocellullose to make a paste of workable viscosity. Heating incidental to the manufacturing process results in firm adhesion of the metal to the ceramic. Alternately, the components may be heated in a separate operation to prove the necessary adhesion.

Figure 5:
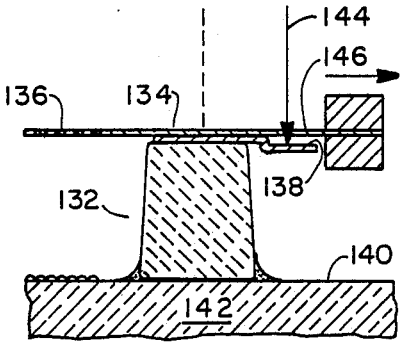
FIGS. 5, 6, 7, 8 and 9 are cross-sectional views in elevation depicting further configurative aspects of the preferred embodiment of a ceramic shadow mask support structure according to the invention.

With regard now to the shadow mask support structure depicted in FIG. 5, structure 132 has disposed thereon means defining a first surface area 134 for receiving and securing shadow mask 136 in tension by high-energy beam welding. Means defining a second surface area 138 is axially or outwardly, offset from first surface area 134 for intercepting and shielding the inner surface 140 of faceplate 142 from the destructive effects of the high-energy beam 144 used to trim post-weld mask waste material 146. Second surface area 138, is depicted as being outboard from first surface area 134. This means defining the two surfaces is indicated symbolically as being composed of a metal, preferably the aforedescribed Carpenter Alloy No. 27. In this embodiment second surface area will be noted as being axially offset from first surface area 134.

Figure 6:
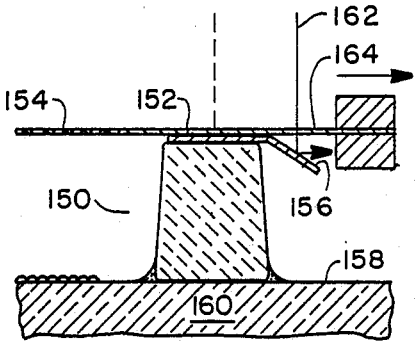

Mask support structure 150 depicted in FIG. 6 is shown as having means defining a first surface area 152 for receiving and securing a shadow mask 154 in tension, and a second surface area 156 indicated as sloping outwardly and downwardly from the inner surface 158 of faceplate 160 to define a non-zero angle relative to inner surface 158. Second surface area 156 is effective, according to the invention, to intercept and reflect away from the inner surface 158 of faceplate 160 the high-energy beam 162 used to trim post-weld mask waste material 164. The non-zero angle may be an angle in the range of 40 to 50 degrees according to the invention, and preferably about 45 degrees.

Figure 7:
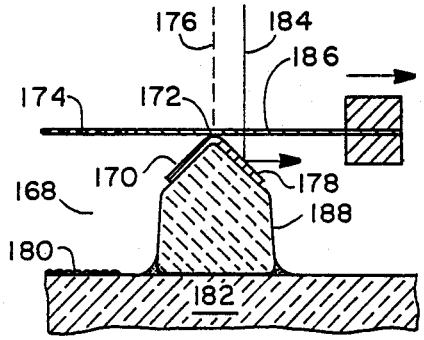

FIG. 7 depicts another configuration of a shadow mask support structure according to the invention. Structure 168, indicated symbolically as being formed from a ceramic, is depicted as having in cross-section the aspect of a house with a saddle roof with sloping sides over which is folded a metal member 170 preferably formed from Alloy No. 27. The peak of metal member 170 is shown as having a flat 172 for receiving and securing a shadow mask 174 in tension by welding by a high-energy beam 176, indicated diagrammatically by the dashed line. The sloping side 178 of member 170 which faces outwardly with respect to screen 180 provides for intercepting and reflecting away from the ceramic and the inner surface of faceplate 182 the high-energy beam 184 in its cutoff mode, indicated diagrammatically by the solid line, when beam 184 is used to trim post-weld mask waste material 186. It is to be noted that slanted side 178 also protects the ceramic body 188 from the effects of the high-energy beam, which can be as destructive to the ceramic material as it is to the glass of the faceplate.

Figure 8:
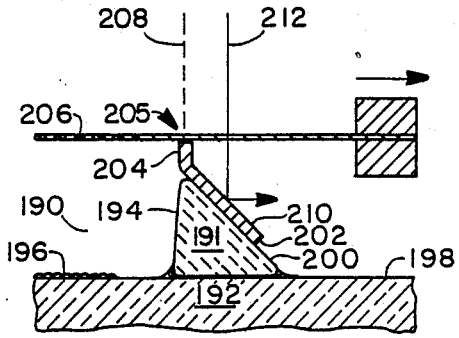

Another support structure configuration according to the invention for use in a cathode ray tube front assembly is depicted in FIG. 8. The body 191 of support structure 190, indicated symbolically as being composed of a ceramic, is shown as being substantially triangular in cross-section and secured to faceplate 192. Structure 190 comprises an inner side 194 adjacent to screen 196, which is centrally disposed on the inner surface 198 of faceplate 192; inner side 194 is shown as being near-perpendicular to the inner surface 198 of the faceplate. An outer side 200 is shown as sloping toward and intercepting inner side 194, and is depicted as defining a non-zero angle relative angle to the inner surface 198; as has been noted heretofore, the non-zero angle may be an angle in the range of 40 to 50 degrees, and preferably about 45 degrees.

A metal member 202 is depicted as being secured to outer side 200 and is indicated as having a bent section 204 extending above the support structure and normal to inner surface 198. Bent section 204 is shown as having a flat peak 205 for receiving and securing a shadow mask 206 in tension by high-energy beam welding, indicated schematically by the dashed line 208, with the means of tensioning indicated diagrammatically by the clamp and associated arrow.

The sloping side 210 of metal member 202 provides for intercepting and reflecting away from the ceramic body of the support structure, and the faceplate inner surface, the high-energy beam 212 in its continuous wave mode when it is used to trim post-weld mask waste material.

Figure 9:
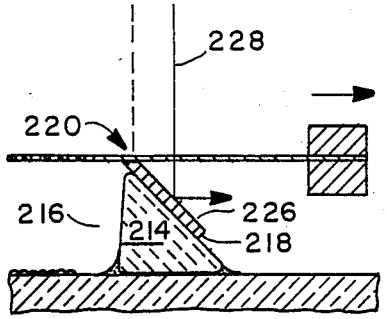

With reference now to FIG. 9, the ceramic body 214 of the support structure 216, is shown as being substantially identical in cross-sectional contour to support structure 109 shown by FIG. 8. To simplify the description, only the differences will be cited. Unlike the support structure configuration shown by FIG. 8, the metal member 218 has no bent section; rather, the flat peak 220 of metal member 218 is formed by grinding the material of the member to be parallel to the inner surface 22 of the faceplate 224. As before, the sloping side 226 of the metal member 218 provides for intercepting and reflecting away from the ceramic of the support structure and the faceplate inner surface the high-energy beam 228 when the beam is used to trim post-weld mask waste material.

While a particular embodiment of the invention has been shown and described, it will be obvious to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. A front assembly for a tension mask color cathode ray tube comprising a faceplate having a tensed foil shadow mask supported by mask support means, and means for shielding said faceplate from a high-energy beam used to trim waste material from said mask following its attachment to said mask support means.

2. A front assembly for a color cathode ray tube including a faceplate having on its inner surface a centrally disposed phosphor screen and a shadow mask support structure composed of a first element secured to said inner surface on opposed sides of said screen and having a mask-receiving surface area for receiving and securing said mask in tension by high-energy beam welding, and a second element outboard from and parallel with said mask-receiving surface area of said first element for shielding said faceplate inner surface from said high-energy beam when said beam is used to trim said mask.

3. A front assembly for a color cathode ray tube including a faceplate having on its inner surface a centrally disposed phosphor screen and a shadow mask support structure secured to said inner surface on opposed sides of said screen, said structure having a first surface area for receiving and securing a shadow mask in tension, and a second surface area sloping outwardly and downwardly toward said faceplate inner surface, and defining a non-zero angle relative to said inner surface effective to intercept and reflect away from said faceplate inner surface a high-energy beam used to trim post-weld waste mask material.

4. The front assembly according to claim 3 wherein said non-zero angle is an angle in the range of 40 to 50 degrees.

5. The front assembly according to claim 3 wherein said non-zero angle is an angle of about 45 degrees.

6. The front assembly according to claim 3 wherein said surface areas for receiving and securing the mask comprise metal.

7. A front assembly for a color cathode ray tube including a faceplate having on its inner surface a centrally disposed phosphor screen and a shadow mask support structure secured to said inner surface on opposed sides of said screen, said support structure providing a surface for receiving and securing a foil shadow mask, and being so structured and arranged as to intercept a high-energy beam used to trim post-weld shadow mask material and to protect said faceplate from said high-energy beam, said structure comprising:

an inner side near-perpendicular to and secured to said faceplate, said inner side leaning toward the outer edge of said faceplate;

a shorter, outer side near-perpendicular to and secured to said faceplate, said outer side leaning toward said inner side;

an intercepting side joined to said outer side at said outer side's terminus farthest from the faceplate, said intercepting side defining a non-zero angle relative to the faceplate inner surface to reflect said high-energy beam sideways and away from said faceplate.

8. The front assembly according to claim 7 wherein said non-zero angle is an angle in the range of 40 to 50 degrees.

9. The front assembly according to claim 7 wherein said non-zero angle is an angle of about 45 degrees.

10. The front assembly according to claim 6 wherein said support structure comprises a metal.

11. A front assembly for a color cathode ray tube including a faceplate having on its inner surface a centrally disposed phosphor screen and a shadow mask support structure composed of a ceramic secured to said inner surface on opposed sides of said screen, said structure having disposed thereon means defining a first surface area for receiving and securing said mask in tension by high-energy beam welding, and means defining a second surface area outboard from said first surface area for shielding said faceplate inner surface from said high-energy beam when used to trim post-weld waste mask material.

12. The faceplate assembly according to claim 11 wherein said means disposed on said structure for receiving said mask comprises a metal.

13. A front assembly for a color cathode ray tube including a faceplate having on its inner surface a centrally disposed phosphor screen and a shadow mask support structure composed of a ceramic secured to said inner surface on opposed sides of said screen, said structure having disposed thereon means defining a first surface area for receiving and securing said mask in tension by high-energy beam welding, and means defining a second surface area axially offset from said first surface area for shielding said faceplate inner surface from a high-energy beam used to trim post-weld waste mask material.

14. A front assembly for a color cathode ray tube including a faceplate having on its inner surface a centrally disposed phosphor screen and a shadow mask support structure composed of a ceramic secured to said inner surface on opposed sides of said screen, said structure having disposed thereon a first area for receiving and securing said mask in tension by high-energy beam welding, and a second area outwardly offset from said first area for intercepting said high-energy beam when used to trim post-weld waste mask material and shielding said faceplate inner surface from the destructive effects of said beam.

15. A front assembly for a color cathode ray tube including a faceplate having on its inner surface a centrally disposed phosphor screen and a shadow mask support structure composed of a ceramic secured to said inner surface on opposed sides of said screen, said structure having disposed thereon means defining a first surface area for receiving and securing said mask in tension by high-energy beam welding, and means defining a second surface area axially offset from said first surface area and sloping downwardly and outwardly toward said faceplate inner surface, said second surface defining a non-zero angle relative to said inner surface of said faceplate effective to intercept and reflect away from said faceplate inner surface said high-energy beam when used to trim post-weld waste mask material.

16. A front assembly for a color cathode ray tube including a faceplate having on its inner surface a centrally disposed phosphor screen and a shadow mask support structure composed of ceramic, said structure having in cross-section the aspect of a house with a saddle roof with sloping sides over which is folded a metal member the peak of which is flat for receiving and securing said mask in tension by high-energy beam welding, the slanted side of said member that faces outwardly with respect to said screen providing for intercepting and reflecting away from said ceramic and said faceplate inner surface said high-energy beam when used to trim post-weld waste mask material.

17. A front assembly for a color cathode ray tube including a faceplate having on its inner surface a centrally disposed phosphor screen and a shadow mask support structure substantially triangular in cross-section composed of ceramic, said structure comprising:

an inner side adjacent to said screen near-perpendicular to and secured to said faceplate;

an outer side sloping toward and intercepting said inner side, said outer side defining a non-zero angle relative to the faceplate said inner surface;

a metal member secured to said outer side and having a bent section extending upwardly and normal to said faceplate inner surface, said bent section having a flat peak for receiving and securing said shadow mask in tension by high-energy beam welding, the sloping side of said metal member providing for intercepting and reflecting away from the ceramic of the support structure and said faceplate inner surface said high-energy beam when used to trim post-weld waste mask material.

18. A front assembly for a color cathode ray tube including a faceplate having on its inner surface a centrally disposed phosphor screen and a shadow mask support structure substantially triangular in cross-section composed of ceramic, said structure comprising:

an inner side adjacent to said screen near-perpendicular to and secured to said faceplate;

an outer side sloping toward and intercepting said inner side, said outer side defining a non-zero angle relative to the faceplate inner surface;

a metal member secured to said outer side and extending above said inner side, said member having a flat peak for receiving and securing said shadow mask in tension by high-energy beam welding, the sloping side of said metal member providing for intercepting and reflecting away from the ceramic of the support structure and said faceplate inner surface said high-energy beam when used to trim post-weld waste mask material.

* * * * *